US009576415B2

(12) United States Patent
Neumann

(10) Patent No.: US 9,576,415 B2
(45) Date of Patent: Feb. 21, 2017

(54) DEVICE FOR SORTING COINS

(71) Applicant: WINCOR NIXDORF INTERNATIONAL GmbH, Paderborn (DE)

(72) Inventor: Thorsten Neumann, Paderborn (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 14/765,892

(22) PCT Filed: Feb. 7, 2014

(86) PCT No.: PCT/EP2014/052430

§ 371 (c)(1),
(2) Date: Aug. 5, 2015

(87) PCT Pub. No.: WO2014/122262

PCT Pub. Date: Aug. 14, 2014

(65) Prior Publication Data

US 2015/0371474 A1 Dec. 24, 2015

(30) Foreign Application Priority Data

Feb. 8, 2013 (EP) ..... 13154681

(51) Int. Cl.

| | |
|---|---|
| ***B07C 5/00*** | (2006.01) |
| ***G07D 3/16*** | (2006.01) |
| ***G07D 3/10*** | (2006.01) |

(52) U.S. Cl.

CPC . *G07D 3/16* (2013.01); *G07D 3/10* (2013.01)

(58) Field of Classification Search

CPC ..... G07D 3/10; G07D 3/16

(Continued)

(56) References Cited

U.S. PATENT DOCUMENTS 3,785,386 A * 1/1974 Kofsky ..... G07D 3/16 194/218
7,553,224 B2 * 6/2009 Choi ..... G07D 3/16 194/334

(Continued)

FOREIGN PATENT DOCUMENTS

| | | |
|---|---|---|
| DE | 37 24 994 | 2/1988 |
| EP | 2 023 301 | 2/2009 |

OTHER PUBLICATIONS

English Translation of International Preliminary Report on Patentability and Written Opinion—Aug. 11, 2015.

(Continued)

*Primary Examiner* — Terrell Matthews
(74) *Attorney, Agent, or Firm* — Gerald E. Hespos; Michael J. Porco; Matthew T. Hespos

(57) ABSTRACT

A device (10) for sorting coins (31) has at least first and second receiving containers (20) for receiving coins (31) and a separating unit (14). Further, a transport unit (18) for transporting coins (31) to the receiving containers (20) is provided and has a first transport section (52) arranged between the separating unit (16) and the first transport container (20). The transport unit (18) also has a second transport section (54) between the first receiving container (20) and the second receiving container (20). A first sensor (62) for detecting coins (31) is arranged in the first transport section (52) and a second sensor (64) for detecting coins (31) is arranged in the second transport section (54). A control unit (24) determines the number of coins (31) fed to the first receiving container (20) dependent on the information obtained from the first sensor (62) and from the second sensor (64).

19 Claims, 3 Drawing Sheets

(58) Field of Classification Search
USPC ..... 209/552, 546, 659, 680
See application file for complete search history.

(56) References Cited

U.S. PATENT DOCUMENTS

| | | | | |
|---|---|---|---|---|
| 2007/0218822 | A1* | 9/2007 | Kim | G07D 9/06 453/10 |
| 2015/0371474 | A1* | 12/2015 | Neumann | G07D 3/10 209/546 |

OTHER PUBLICATIONS

International Search Report of May 16, 2014.
European Search Report of Jul. 26, 2013.

* cited by examiner

| Münze | A | A | B | C | B | A | D | E | E | A | B | C | D | C | C | 71 |
|---|---|---|---|---|---|---|---|---|---|---|---|---|---|---|---|---|
| SOLL | 32 | 32 | 34 | 36 | 34 | 32 | 38 | 40 | 40 | 32 | 34 | 36 | 38 | 36 | 36 | 72 |
| IST1 | 32 | 32 | 34 | 36 | **36** | 32 | 38 | 40 | 40 | 32 | 34 | 36 | 38 | 36 | 36 | 74 |
| IST2 | 32 | 32 | 34 | 36 | **38** | 32 | 38 | 40 | 40 | 32 | 34 | 36 | 38 | 36 | 36 | 76 |
| IST3 | 32 | 32 | 34 | 36 | 34 | **34** | 38 | 40 | 40 | 32 | **36** | 36 | 38 | 36 | 36 | 78 |
| IST4 | 32 | 32 | 34 | 36 | 34 | 32 | 38 | 40 | 40 | **34** | 34 | **38** | 38 | 36 | 36 | 80 |

FIG. 4

| | SOLL | | IST1 | | IST2 | | IST3 | | IST4 | |
|---|---|---|---|---|---|---|---|---|---|---|
| Sensor 62 | 15 | 4xA | 15 | 4xA | 15 | 4xA | 15 | **3xA** | 15 | **3xA** |
| Sensor 64 | 11 | 3xB | 11 | **2xB** | 11 | **2xB** | **12** | 3xB | **12** | **4xB** |
| Sensor 66 | 8 | 4xC | **9** | **5xC** | **9** | 4xC | **9** | **5xC** | 8 | **3xC** |
| Sensor 68 | 4 | 2xD | 4 | 2xD | **5** | **3xD** | 4 | 2xD | **5** | **3xD** |
| Sensor 70 | 2 | 2xE | 2 | 2xE | 2 | 2xE | 2 | 2xE | 2 | 2xE |
| | 82 | 84 | 86 | 88 | 90 | 92 | 94 | 96 | 98 | 100 |

FIG. 5

DEVICE FOR SORTING COINS

BACKGROUND

1. Field of the Invention

The invention relates to a device for sorting coins, comprising a first and at least a second receiving container for receiving coins. Further, the device has a separating unit for separating coins and a transport unit for transporting coins from the separating unit to the first receiving container arranged downstream of the separating unit and the second receiving container arranged downstream of the first receiving container, the transport unit having a first transport section and a second transport section. The first transport section is arranged between the separating unit and the first receiving container so that along the first transport section both the coins to be fed to the first receiving container and to the second receiving container are transported. The second transport section is arranged between the first and the second transport container so that along the second transport section only the coins which have not been fed to the first receiving container are transported.

2. Description of the Related Art

In devices for the input and/or output of coins the coins input as an unsorted quantity of coins are distributed to a plurality of receiving containers, so-called coin hoppers, after they have been separated, their authenticity has been checked and their denomination has been determined. In particular, a type-specific storage of the coins is carried out, i.e. that for each denomination at least one receiving container is provided.

For this, in particular a sorting path is provided which comprises a support surface on which the coins rest during transport and in which several holes having an increasing size in the transport direction of the coins are arranged. One coin receiving container each is arranged under each of these holes, so that the coins are distributed to the individual receiving containers dependent on their size. Due to the high processing speed and the different condition of the coins it may, however, happen that a coin is inadvertently fed to an incorrect receiving container. This is particularly critical when the coins are again disbursed since, when an incorrect coin is received in a coin hopper, thus the incorrect amount of money would be disbursed.

Therefore, devices are known in which for determining the correct feeding of the individual coins to the individual receiving containers light barriers for detecting the coins are arranged in the entry area of the receiving containers or in the area between the hole and the receiving container, i.e. in any case in the area in which the coins are in free fall. Such devices are known, for example, from documents DE 20 2006 007 932 U1 and DE 29 807 688 U1. What is problematic here is that in the case of coins which are in free fall it may easily happen that due to the rotation of the coins and the close sequence of successively fed coins, the light beam of the light barrier is continuously interrupted in the case of two successively fed coins so that the two coins are perceived as only one coin by the light barrier. It may also happen that in the case of an unfortunate rotation and position a coin does not interrupt the light beam at all. Both results in incorrect determinations of the number of coins fed to the corresponding receiving container. Further, it may happen that the light beam of the light barrier is permanently interrupted when the receiving container has a filling level that is so high that the received coins are stacked up to the area of the light barrier.

It is the object of the invention to specify a device for sorting coins, in which a monitoring of the orderly feeding of the coins to the individual receiving containers is reliably possible in an easy manner.

SUMMARY

According to the invention, a first sensor for detecting coins transported along the first transport section is arranged in the first transport section. Likewise, a second sensor for detecting coins transported along the second transport section is arranged in the second transport section. A control unit determines the number of coins fed to the first receiving container dependent on the information obtained from the first sensor and from the second sensor. During the transport along the first transport section and the second transport section the coins have a predetermined orientation and do not rotate either. In particular, the coins rest on a support surface along which they move. By providing the sensors in these transport sections of the transport unit it is guaranteed that the individual coins can be detected reliably so that the number of coins transported along the first transport section and the number of coins transported along the second transport section can be determined reliably. Accordingly, on the basis of these two values the coins fed to the first receiving container can be calculated with high accuracy.

Further, by arranging the sensors in the transport sections and thus outside the receiving containers it is guaranteed that it will not happen that in the case of a high filling level of the receiving container (so-called turret formation) at least one coin is permanently arranged in the detection area of the sensor and thus prevents a detection of further fed coins.

The terms upstream and downstream refer to the transport direction of the coins along the transport path within which they are transported in the device.

Preferably, the control unit determines the number of coins transported along the first transport section by means of the first sensor and the number of coins transported along the second transport section by means of the second sensor. Further, the control unit determines the number of coins fed to the first receiving container in particular by subtracting the number of coins transported along the second transport section from the number of coins transported along the first transport section. Since the difference between the coins transported along the first transport section and the coins transported along the second transport section could only have been fed to the first transport container, the corresponding number can be determined reliably in this way.

In a particularly preferred embodiment of the invention, at least a third receiving container for receiving coins is provided. It is particularly advantageous when a plurality of further receiving containers for receiving coins is provided. In particular, the number of provided receiving containers corresponds to the number of different denominations of the currency set to be handled. In the case of EURO coins, thus in particular eight receiving containers are provided, the receiving containers being arranged one after the other with respect to the transport direction. In the transport section of the transport unit present between two successively arranged receiving containers, one sensor each for detecting coins is provided. The control unit then determines the number of coins fed to one of the receiving containers each time by subtracting the number determined in the transport section arranged after the receiving container from the number of coins determined in the transport section before the receiving container. Thus, the number of fed coins can be determined for each receiving container in an easy manner.

For the last receiving container, as viewed in transport direction, it is not necessary to provide a further sensor after this container so that the control unit assumes the number determined by the sensor arranged immediately before the last receiving container as the number of coins fed thereto. Both the first sensor and the second sensor preferably each comprise a light barrier, wherein by the interruption of the light barrier each time the transport of one coin along this transport section is detected. In a preferred embodiment of the invention, also the further sensors for detecting coins each comprise a light barrier. The use of light barriers has the advantage that the coins can be detected easily and reliably by means of them and the light barriers have low purchase costs. Alternatively, instead of light barriers also ultrasound sensors, capacitive sensors and/or inductive sensors can be used. It is likewise possible that different types of sensors are used in the various transport sections.

Further, a checking unit for determining the denomination of fed coins can be provided, wherein on the basis of the determined denominations the control unit defines for each receiving container a target value of coins to be fed thereto as planned. In particular, it is preset for each coin receiving container how many coins of which denomination are to be fed thereto. On the basis of this predetermined scheme, the control unit determines by the comparison of the corresponding number of coins of the individual denominations how many coins would have to be fed to the respective receiving container if the feeding takes place according to the preset distribution.

The checking unit in particular not only serves to determine the denomination but also to check the authenticity of the coins. Coins which are classified as being fake and/or other objects are in particular sorted out before the other coins are fed to the receiving containers by the transport unit.

The checking unit is in particular arranged upstream of the transport unit and downstream of the separating unit.

It is particularly advantageous when the control unit compares the number of the fed coins determined by means of the sensors, i.e. the actual number, to the corresponding target value for at least one of the receiving containers. It is particularly advantageous when the control unit makes a comparison of the actually fed number to the target value for each receiving container. By means of this comparison, the control unit can easily determine whether the distribution of the coins to the individual coin receiving containers has been carried out in accordance with the predetermined scheme or whether a coin has been fed to an incorrect receiving container.

The control unit can make a comparison between the target value and the actually fed number of coins after the feeding of each individual coin, after the feeding of a predetermined number of coins and/or after the feeding of all coins input into the device as an amount of coins. The comparison after the feeding of each individual coin has the advantage that the occurrence of an error can be recognized at once. The comparison after the feeding of a predetermined number of coins and/or all coins of a quantity of coins, on the other hand, offers the advantage that less comparisons are required. Since the disbursement of coins only takes place again when all coins of a quantity of coins input at the same time have been distributed to the receiving containers, there is no risk during the distribution of the coins that due to the incorrect feeding of a coin to an incorrect receiving container an incorrect amount could be disbursed.

In a particularly preferred embodiment of the invention, the control unit not only determines that at least one coin has been fed to an incorrect receiving container but specifically determines to which receiving container the incorrect coin has been fed. This can be done in that the control unit compares to which receiving containers too few and to which receiving containers too many coins are fed. When more coins are fed to a receiving container than coins of the corresponding denomination have been input, then at least one incorrect coin has to be contained in such a receiving container.

It is particularly advantageous when the control unit does not use those receiving containers in which at least one coin intended for this receiving container has been received for the output of coins via an output unit. For this, the control unit in particular replaces the denomination to be removed inadvertently from this receiving container by a corresponding number of coins of other denominations from other receiving containers.

In an alternative embodiment of the invention, it is also possible that the control unit does not only not use those receiving containers for the later disbursement in which a non-assigned coin has been received but all receiving containers in which the actual value differs from the target value.

The transport unit is in particular designed such that it has a support surface on which the coins rest during the transport along the transport unit. In the support surface in particular several holes are provided, wherein under each hole one of the receiving containers is arranged. The holes differ in their size, the size of the holes increasing from hole to hole as viewed in transport direction so that the coins are distributed to the individual receiving containers corresponding to their size and thus corresponding to their denomination without elements which are to be controlled actively being necessary. Thus an easy, cost-efficient solution for an effective sorting is achieved.

The sensors are preferably arranged shortly before the holes so that the number of coins fed to the holes can be determined by them. Here, the distance is chosen such that the coins still rest on the support surface and are not yet falling into the hole when they are transported past the sensors.

In an alternative embodiment of the invention, also actively controlled elements for sorting the coins to the respective receiving containers can be used instead of a support surface with holes.

Further, it is advantageous when the device has an output unit for the output of information, wherein the control unit, when it has determined the incorrect feeding of at least one coin to a receiving container, controls the output unit such that it outputs an information hereon to an operator. The output can, in particular, be accomplished via a display, a warning sound and/or a screen. Thus, an operator can easily remedy the incorrect sorting. Since, on the basis of this information, the operator in particular specifically knows to which of the receiving containers a coin has been fed incorrectly, the operator only has to manually correct this receiving container accordingly.

Further features and advantages of the invention result from the following description which explains the invention in more detail on the basis of embodiments in connection with the enclosed Figures.

BRIEF OF THE DRAWINGS

FIG. 4 shows a table of a sequence of fed coins and possible distributions to the individual receiving containers.

FIG. 5 shows a table of the sensor values resulting in the individual cases according to FIG. 4.

DETAILED DESCRIPTION

Figure 1:
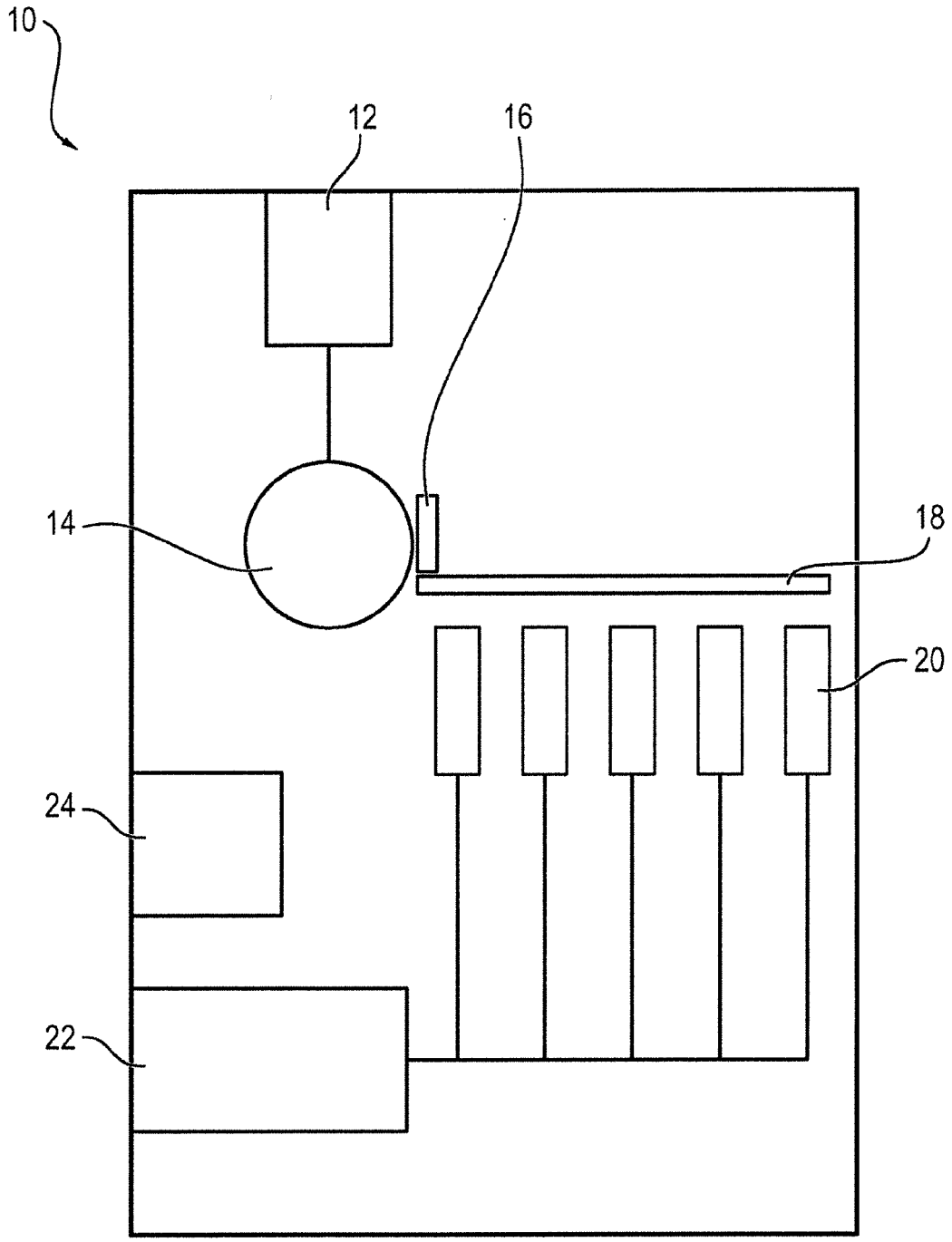
FIG. 1 shows a schematic illustration of a device for sorting coins.

In FIG. 1, a schematic illustration of a device 10 for sorting coins is illustrated. The device 10 is in particular a device for the input and/or the output of coins. The coins to be input are input via an input compartment 12 and are fed to a separating unit 14 for separating the input coins. The separating unit 14 is in particular designed in the form of a coin centrifuge in which the coins are transported individually through a hole in the wall of the coin centrifuge by centrifugal forces acting on them. The separated coins are checked for their authenticity by means of a checking unit 16. Coins classified as being fake and/or foreign objects are sorted out. For coins classified as authentic the denomination is determined. Subsequently, the coins are distributed to coin receiving containers by means of a transport unit 18, one of which is exemplarily identified with the reference sign 20. In the illustrated example, five receiving containers 20 are provided. To simplify matters, in FIG. 1, as in the following FIGS. 2 and 3, the transport unit 18 is linearly shown. However, the transport unit 18 can also have any other form. In particular, the transport unit 18 and thus also the receiving containers 20 can be arranged circularly around the coin centrifuge 14 so that a particularly compact design is achieved. The coins received in the receiving containers 20 can again be removed from these and output via an output unit 22.

Figure 2:
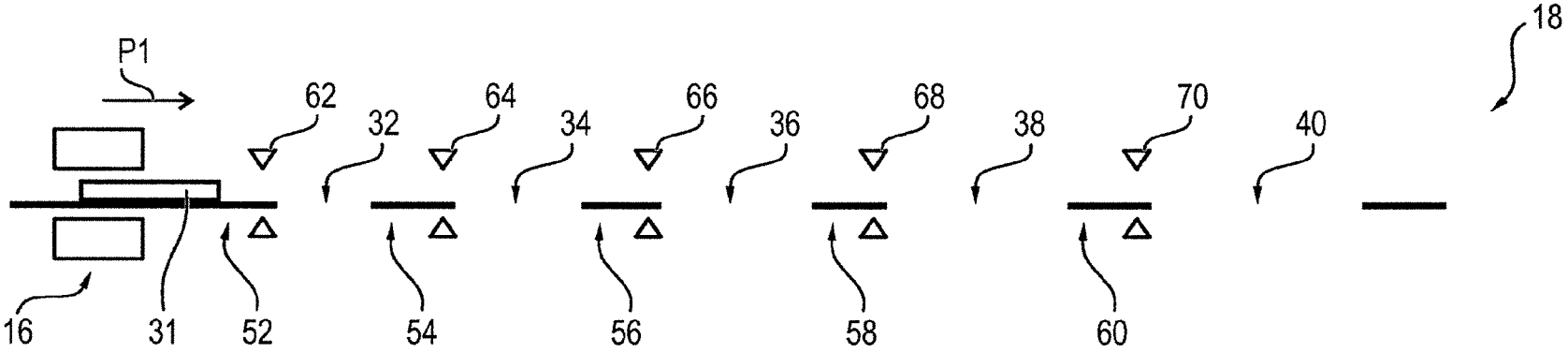
FIG. 2 shows a highly simplified side view of a detail of the device for handling coins.
Figure 3:
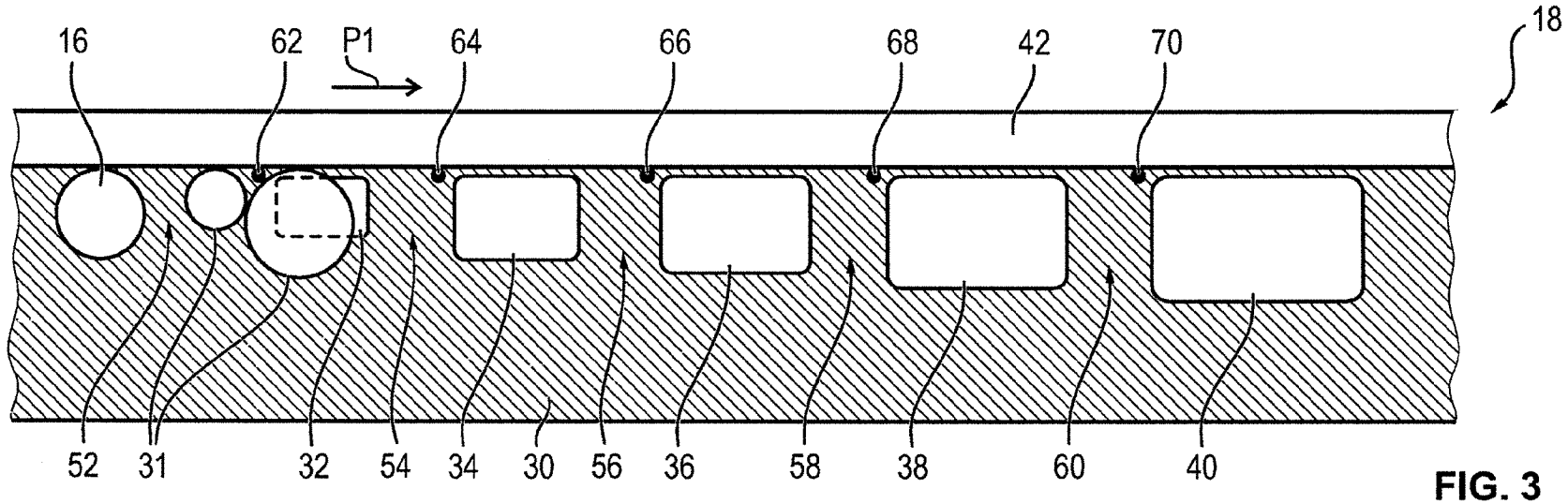
FIG. 3 shows a highly simplified illustration of a top view of the detail from FIG. 2.

In FIG. 2, a highly simplified illustration of a detail of the device 10 according to FIG. 1 is illustrated, wherein only the checking unit 16 and the transport unit 18 are illustrated. In FIG. 3, a top view of this detail is shown.

The transport unit 18 comprises a support surface 30 on which the coins 31 are transported in a transport direction P1 resting on their face or reverse. In doing so, the coins 31 bear with their edges against a guiding element 42 so that they have a predetermined orientation on the support surface 30.

In the support surface 30, five holes 32 to 40 are provided, and exactly one receiving container 20 is arranged under each hole. Thus, under the first hole 32 a first receiving container 20 is arranged, under the second hole 34 a second receiving container 20 is arranged, under the third hole 36 a third receiving container 20 is arranged, under the fourth hole 38 a fourth receiving container 20 is arranged and under the fifth hole 40 a fifth receiving container 20 is arranged. Here, the receiving containers 20 can be arranged such that coins which fall through the corresponding hole 32 to 40 directly fall into this receiving container 20. Alternatively, also further transport and/or deflecting elements can be provided via which the coins 31 are transported or deflected before they are fed to the actual receiving container 20.

The dimensions of the holes 32 to 40 increase in size, as viewed in transport direction P1, so that, as can be well seen in FIG. 3 on the basis of the two coins 31 illustrated exemplarily, at first the smallest coins 31 are sorted out through the first hole 32, then the coins 13 next in size through the second hole 34 and so on. Thus, the coins 31 can be distributed to the individual receiving containers 20 based on their size and thus based on their denomination.

The transport path along which the coins are transported with the aid of the transport unit 18 is divided into a first transport section 52, a second transport section 54, a third transport section 56, a fourth transport section 58 and a fifth transport section 60 by means of the holes 32 to 40, wherein the first transport section 52 is arranged between the checking unit 16 and the first hole 32, the second transport section 54 is arranged between the first hole 32 and the second hole 34, the third transport section 56 is arranged between the second hole 34 and the third hole 36, the fourth transport section 58 is arranged between the third hole 36 and the fourth hole 38, and the fifth transport section 60 is arranged between the fourth hole 38 and the fifth hole 40. Within each of these transport sections 52 to 60, one sensor each designed as a light barrier 62 to 70 is arranged, by means of which the coins 31 transported along the respective transport section 52 to 60 can be detected.

On the basis of the information obtained via the light barriers 62 to 70, i.e. the number of coins 31 transported along the respective transport sections 52 to 60, a control unit 24 of the device 10 can easily determine the coins 31 fallen into the respective hole 32 to 40 and thus the coins 31 fed to the respective receiving container 20.

For determining the coins 31 fed to the first receiving container 20, i.e. those coins 31 which have fallen from the transport path through the first hole 32, the control unit 21 subtracts from the number of coins 31 determined by means of the second light barrier 64 the number of coins 31 determined by means of the first light barrier 62 in the first transport section 52.

The determination of the coins 31 fed to the individual holes 32 to 40 and thus to the receiving containers 20 by means of light barriers 62 to 70 arranged before the holes 32 to 40 along the transport path of the transport unit 18 has, as compared to light barriers arranged under the holes 32 to 40, the advantage that the coins 31 rest on the support surface 30 in a predetermined orientation and bear against the guiding element 32 during their detection via the light barrier 62 to 70.

This has the advantage that each coin can be detected individually reliably. Since all coins 31 bear against the guiding element 32 with their edges, between two successively transported coins 31 a free gap is always present at least in the area directly adjacent to the guiding element 32 as all coins 31 have a circular shape. Since the light barriers 62 to 70 are orientated such that their light beam is arranged in this area, it is guaranteed that it will not happen that the light beam is continuously interrupted by two successively transported coins 31 and thus two coins 31 would be interpreted as only one coin 31.

Thus, the coins 31 fed to the individual holes 32 to 40 and thus to the individual receiving containers 20 can be determined reliably and safely in an easy manner.

In FIG. 4, a table of a sequence of fed coins is illustrated, wherein in the first line 71 the coins 31 successively fed to the transport unit 18 are listed with their respective denomination. In the assumed example, coins of five different denominations, namely the denominations A, B, C, D and E are fed, wherein, as planned, the coins of the denomination A are to be fed to the first receiving container 20 via the first hole 32, the coins of the denomination B are to be fed to the second receiving container 20 via the second hole 34, the coins of the denomination C are to be fed to the third receiving container 20 via the third hole 36, the coins of the denomination D are to be fed to the fourth receiving container 20 via the fourth hole 38 and the coins of the denomination E are to be fed to the fifth receiving container 20 via the fifth hole 40.

In the second line 72, the target distribution of the coins to the individual holes 32 to 40 and thus to the corresponding receiving containers 20 is illustrated, the numbers indicated in line 72 corresponding to the reference signs of the corresponding holes 31 to 40. In the target distribution, thus all coins of the denomination A are transported through the first hole 32, all coins of the denomination B are transported through the second hole 34, all coins of the denomination C are transported through the third hole 36, all coins of the denomination D are transported through the fourth hole 38, and all coins of the denomination E are transported through the fifth hole 40. Thus, in the target distribution in accordance with line 72, fifteen coins are transported along the first transport section 52 so that fifteen coins are detected by the first sensor 62. Out of these fifteen coins, all coins of the denomination A, i.e. four coins, are transported through the first hole 32 so that along the second transport section 54 only eleven coins are still transported and detected by the second sensor 64 accordingly. Through the second hole 34 all coins of the denomination B fall, i.e. three coins, so that along the third transport section 56 only eight coins are still transported. Accordingly, the third sensor 66 detects only eight coins.

Since afterwards all coins of the denomination C, i.e. four coins, fall through the third hole 36, only four coins are still transported along the fourth transport section 58 and are detected by the fourth sensor 68, accordingly.

The two coins of the denomination D fall into the fourth hole 38 so that only the two remaining coins of the denomination E are transported along the fifth transport section 60 and are detected by the fifth sensor 70, i.e. by the light barrier 70.

In FIG. 5, these corresponding values of the individual sensors 62 to 70 are entered into the column 82. In column 84, each time the difference between the respective values of the corresponding sensors 62 to 70 are indicated, i.e. those values which are also determined by the control unit 24 by means of the corresponding subtraction of the values of two adjacent sensors 62 to 70, and which corresponds to the number of coins fed to the hole 32 to 40 which is arranged between the two sensors 62 to 70.

In the third line 74 of the table according to FIG. 4, a first error scenario is illustrated, in which the fifth coin is now only fed to the third hole 36 instead of the second hole 34. In column 86 in the table of FIG. 5, the sensor values are illustrated which result in the case of this corresponding first error scenario. The column 88 indicates the difference values between the values respectively determined by the sensors 62 to 70. In this first error scenario, the control unit 24 can easily determine by means of comparison between the now obtained actual values and the actual target values, as these are indicated in column 84, that a coin which actually should have been fed to the second receiving container 20 through the second hole 34 was incorrectly fed to the third receiving container 20 through the third hole 36.

In a preferred embodiment, the control unit 24 blocks in such a case the third receiving container 20 with respect to a disbursement of coins 31 so that an incorrect denomination will not be paid out inadvertently. In addition, in particular also an error message can be output so that an operator knows in which receiving container 20 an error occurred, and the operator can correct this error accordingly.

In the fourth line of the table of FIG. 4, a second error scenario is illustrated in which the fifth coin only falls into the fourth hole 38 instead of the second hole 34. As shown by the resulting actual values of the sensors 62 to 70 in column 90 of the table of FIG. 5 and the differences in column 92 calculated therefrom, the control unit 24 determines in this case that only two instead of three coins were fed to the second receiving container 20 and, in return, three instead of only two coins were fed to the fourth receiving container 20.

In line 78 of FIG. 4, a further error scenario is illustrated, in which the sixth coin 31 falls through the second hole 34 instead of the first hole 32 and the eleventh coin falls through the third hole 36 instead of the second hole 34. In columns 94 and 96, the sensor readings resulting therefrom and the difference values derived therefrom are indicated.

In line 80 in FIG. 4, a further error scenario is illustrated, in which the tenth coin falls through the second hole 34 instead of the first hole 32, and the twelfth coin falls through the fourth hole 38 instead of the third hole 36. As shown by the resulting actual values in columns 98 and 100 of the table according to FIG. 5, given this constellation there results a deviation of the actual stock from the target stock for each of the first, the second, the third and the fourth receiving container 20, wherein in particular the receipt of too many coins in the second receiving container and in the fourth receiving container is critical.

In an alternative embodiment of the invention, instead of light barriers 62 to 70 also other sensors, in particular other optical sensors, ultrasound sensors, capacitive sensors and/or inductive sensors can be used. Further, it is alternatively possible that less than five receiving containers 20 and correspondingly less than five holes 32 to 40 or more than five receiving containers 20 and correspondingly more than five holes 32 to 40, in particular eight receiving containers 20 are used.

LIST OF REFERENCE SIGNS

10 device
12 input compartment
14 separating unit
16 checking unit
18 transport unit
20 receiving container
22 output unit
24 control unit
30 support surface
32 to 40 hole
31 coin
42 guiding element
52 to 60 transport section
62 to 70 sensor
71 to 80 line
82 to 100 column
P1 transport direction

The invention claimed is:

1. A device for sorting coins, comprising:

a separating unit (14) for separating the coins (31), a checking unit (16) for determining denominations of the separated coins (31), a first and at least a second receiving container (20) for receiving the coins (31) that have passed the checking unit, a transport unit (18) for transporting the coins (31) from the separating unit (14) to the first receiving container (20) arranged downstream of the separating unit (14) and the second receiving container (20) arranged downstream of the first receiving container (20), wherein the transport unit (18) has a first transport section (52) between the separating unit (14) and the first transport container (20) and along which both the coins to be fed to the first receiving container (20) and to the second receiving container (20) are transported, and a second transport section (54) between the first transport container (20) and the second transport container (20) and along which only the coins not fed to the first transport container (20) are transported, a first sensor (62) in the first transport section (52) for detecting coins (31) transported along the first transport section (52), a second sensor (64) in the second transport section (54) for detecting coins (31) transported along the second transport section (54), and a control unit (24) that determines on the basis of the denominations determined by the checking unit (16) for each receiving container (20) a target value of the coins (31) to be fed thereto, and that, dependent on the information obtained from the first sensor (62) and from the second sensor (64), determines the number of coins (31) fed to the first receiving container (20) and that then compares for each of the receiving containers (20), the number of fed coins (31) determined by the sensors (62 to 70) to the corresponding target value.

2. The device (10) of claim 1, wherein the control unit (24) determines the number of coins (31) transported along the first transport section (52) as detected by the first sensor (62), the control unit (24) determines the number of coins transported along the second transport section (54) as detected by the second sensor (64), and the control unit (24) determines the number the coins fed to the first receiving container (20) by subtracting the number of coins transported along the second transport section (54) from the number of coins (31) transported along the first transport section (52).

3. The device (10) of claim 1, further comprising at least a third receiving container (20) for receiving coins (31), the transport section (52 to 60) of the transport unit (18) has one of the sensors (62 to 70) between all of the successively arranged receiving containers for detecting coins (31).

4. The device (10) of claim 3, wherein the control unit (24) determines the number of coins (31) fed to one of the receiving containers (20) by subtracting the number of coins (31) determined by the sensor (62 to 70) arranged immediately after the respective receiving container (20) from the number of coins (31) determined by the sensor (62 to 70) arranged immediately before the respective receiving container (20).

5. The device (10) of claim 1, wherein the control unit (24) defines as the number of coins (31) fed to the last receiving container (20), as viewed in transport direction (P1) of the coins (31), the number of coins (31) being determined by the sensor (70) arranged immediately before the last receiving container (20).

6. The device (10) of claim 1, wherein at least one of the sensors (62 to 70) for detecting coins (31) comprises at least one of a light barrier, an ultrasound sensor, a capacitive sensor and an inductive sensor.

7. A device (10) for sorting coins, comprising:

a first and at least a second receiving container (20) for receiving the coins (31), a separating unit (14) for separating the coins (31), and a transport unit (18) for transporting the coins (31) from the separating unit (14) to the first receiving container (20) arranged downstream of the separating unit (14) and the second receiving container (20) arranged downstream of the first receiving container (20), wherein the transport unit (18) has a first transport section (52) between the separating unit (14) and the first transport container (20) and along which both the coins to be fed to the first receiving container (20) and to the second receiving container (20) are transported, and a second transport section (54) between the first transport container (20) and the second transport container (20) and along which only the coins not fed to the first transport container (20) are transported, a first sensor (62) in the first transport section (52) for detecting coins (31) transported along the first transport section (52), a second sensor (64) in the second transport section (54) for detecting coins (31) transported along the second transport section (54), a control unit (24) that, dependent on the information obtained from the first sensor (62) and from the second sensor (64), determines the number of coins (31) fed to the first receiving container (20), and an output unit for outputting information, and that the control unit (24), when it has determined an incorrect feeding of at least one coin (31) to a receiving container (20), controls the output unit to output an information thereon to an operator.

8. The device (10) of claim 7, further comprising at least a third receiving container (20) for receiving coins (31), the transport section (52 to 60) of the transport unit (18) has one of the sensors (62 to 70) between all of the successively arranged receiving containers for detecting coins (31).

9. The device (10) of claim 7, further comprising a checking unit (16) for determining denominations of fed coins (31), and the control unit (24) determines on the basis of the determined denominations for each receiving container (20) a target value of the coins (31) to be fed thereto as planned.

10. The device (10) of claim 9, wherein the control unit (24) compares for at least one receiving container (20), the number of fed coins (31) determined by means of the sensors (62 to 70) to the corresponding target value.

11. The device (10) of claim 1, wherein the control unit (24) compares the number of fed coins (31) determined by the sensors (62 to 70) to the corresponding target value each time after the feeding of each coin (31), after the feeding of a predetermined number of coins (31) and/or after the feeding of all coins (31) fed to the device (10) as a quantity of coins.

12. The device (10) of claim 10, wherein the control unit (24) determines, dependent on the result of the comparison or the results of the comparisons, in which receiving container (20) at least one non-assigned coin (31) has been received.

13. The device (10) of claim 12, wherein the control unit (24) does not use receiving containers (20) in which at least one non-assigned coin (31) has been received for the output of coins (31) via an output unit (22).

14. The device (10) of claim 11, characterized in that the control unit (24) does not use receiving containers (20) in which the number of fed coins (31) determined by means of the sensors (62 to 70) deviates from the corresponding target value for the output of coins (31) via an output unit (22).

15. The device (10) of claim 1, wherein the transport unit (18) has a support surface (30) on which the coins (31) rest during transport, holes (32 to 40) being provided in the support surface (30) one of the receiving containers (20) being arranged under each of the holes (32 to 40).

16. The device (10) of claim 1, further comprising an output unit for outputting information, and that the control unit (24), when it has determined an incorrect feeding of at least one coin (31) to a receiving container (20), controls the output unit to outputs an information thereon to an operator.

17. The device (10) of claim 8, wherein the control unit (24) determines the number of coins (31) fed to one of the receiving containers (20) by subtracting the number of coins (31) determined by the sensor (62 to 70) arranged immediately after the respective receiving container (20) from the number of coins (31) determined by the sensor (62 to 70) arranged immediately before the respective receiving container (20).

18. The device (10) of claim 1, wherein the control unit (24) defines as the number of coins (31) fed to the last receiving container (20), as viewed in transport direction (P1) of the coins (31), the number of coins (31) being determined by the sensor (70) arranged immediately before the last receiving container (20).

19. The device (10) of claim 15, wherein the holes (32 to 40) increase in size from hole to hole as viewed in transport direction (P1).

* * * * *